United States Patent [19]

Adicoff

[11] 3,994,696

[45] Nov. 30, 1976

[54] ALUMINUM SOAP DEMISTING AGENT IN JET FUEL

[76] Inventor: Arnold Adicoff, 641 Sonja, Ridgecrest, Calif. 93555

[22] Filed: May 22, 1975

[21] Appl. No.: 579,770

[52] U.S. Cl. ..... 44/7 A

[51] Int. Cl.[2] ..... C10L 7/02

[58] Field of Search ..... 44/7 A, 7 E

[56] References Cited

UNITED STATES PATENTS

| | | | |
|---|---|---|---|
| 2,978,411 | 4/1961 | Leverberg et al. | 44/7 A |
| 3,020,133 | 2/1962 | Feild et al. | 44/7 A |
| 3,323,883 | 6/1967 | Hottor | 44/7 A |
| 3,527,582 | 9/1970 | Haigh et al. | 44/7 E X |
| 3,539,311 | 11/1970 | Cohen et al. | 44/7 A |
| 3,628,927 | 12/1971 | Baumgartner | 44/7 A |
| 3,666,430 | 5/1972 | Osmond et al. | 44/7 E X |
| 3,820,963 | 6/1974 | Moore et al. | 44/7 E X |

*Primary Examiner*—Edward A. Miller

*Attorney, Agent, or Firm*—R. S. Sciascia; Roy Miller; Lloyd E. K. Pohl

[57] ABSTRACT

Compositions of matter comprising a mixture of a jet fuel and an aluminum di-acid soap of a saturated carboxylic acid having from 8 to 20 carbon atoms are disclosed. The compositions of matter are useful as fuels for jet aircraft.

1 Claim, No Drawings

ALUMINUM SOAP DEMISTING AGENT IN JET FUEL

CROSS-REFERENCE TO RELATED APPLICATIONS

This application is related to copending U.S. patent application Ser. No. 475,688 filed June 3, 1974.

BACKGROUND OF THE INVENTION

1. Field of the Invention.

This invention relates to improved jet fuels. More particularly, this invention relates to compositions of matter comprising a mixture of a jet fuel and an aluminum di-acid soap of a saturated carboxylic acid having from 8 to 20 carbon atoms.

2. Description of the Prior Art.

When an airplane crashes or is forced to crash land or subjected to various other impulsive mishaps, its fuel tanks are often punctured or ruptured. When this happens, fuel from within the tanks spread into the atmosphere. Much of the fuel is in the form of a fine spray or mist. The tiny mist droplets are, because of their extremely large surface area, easily ignitable. If ignition occurs, a large, spreading fireball results.

It would be advantageous if the fuel were such that fine mist droplets were prevented from forming in the case of a fuel tank puncture or rupture mishap. That is, it would be advantageous if the viscosity were such that the fuel spread was minimized and, should aspiration occur, relatively large drops rather than small mist droplets would form.

In the past, various materials have been added to jet fuels to increase viscosities. Polyisobutylene, polyisoprene, copolymers of ethylene acetate and vinyl acetate and various acrylic polymers and copolymers have been experimented with as demisting agents. These materials have been added to the fuel in amounts varying from 0.1 to 3 percent of the total weight of the composition.

The prior art materials have had certain disadvantages associated with them. First, their demisting properties, i.e., their ability to make the viscosity of the fuel such that fine mists do not form when mishaps occur, have been detrimental to ignition and combustion properties in engines. When the "demisted" fuel is injected into an engine for burning, the fuel is in the form of large drops. This makes ignition in the engine difficult. Ignition is particularly difficult during cold starts and after flameouts. Second, the previously tested materials tend to degrade when subjected to shear forces when the fuel is pumped. Single bond rupture of these very high molecular weight polymer chains causes very sharp reductions in the viscosity causing the fuel to lose its demisted quality. Third, occasions arise in maintenance of aircraft, when it is desirable to remove the fuel from the tanks. Fuels thickened with state of the art polymeric thickeners are difficult to remove and completely drain from the aircraft (about 10% of the fuel remains as hold up).

SUMMARY OF THE INVENTION

It has now been found that certain aluminum soaps can be used as demisting agents in jet fuels. It has further been found that if certain amines are pumped into fuel lines carrying fuel which contains the aluminum soaps, the thickening (demisting) effect of the soaps is destroyed and the fuel, upon being injected into the engine by the fuel injectors, is injected as a fine mist.

DESCRIPTION OF THE PREFERRED EMBODIMENT

Leonard Cohen, in U.S. Pat. No. 2,741,629, describes the preparation of an aluminum di-acid soap of mixed iso-octanoic acids. This soap is particularly useful in the practice of this invention. It is prepared by reacting mixed iso-octanoic acids with sodium hydroxide to form the sodium salt of the acids and water and then reacting the sodium salt with more sodium hydroxide and aluminum sulfate to form the soap. The soap comes out of the reaction mixture as a precipitate and is easily recovered.

Other aluminum di-acid soaps may be used in the practice of this invention. Any of those made from saturated carboxylic acids having from about 8 to about 20 carbon atoms are suitable. They can all be prepared by the method described by Cohen.

In the practice of this invention, either one or a mixture of two or more of the above-described aluminum soaps are added to jet fuel such as JP-4, JP-5, or Jet-A. The military jet fuels, JP-4 and JP-5 are described in Military Specification MIL-T-5624H. The civilian jet fuels such as Jet A and others are described in the American Society for Testing and Materials specification D 1655-74. An addition of from 0.1 to 1.0 weight percent of the total fuel is preferred. Such an addition increases the viscosity of the fuel to a point where relatively large drops rather then fine mist droplets will form if a fuel tank containing the fuel is accidently punctured or ruptured. On the other hand, the viscosity of the fuel is still low enough to permit the fuel to be pumped from existing, in-use fuel tanks through fuel lines.

Fuel which has had its viscosity increased by an addition of aluminum soaps according to this invention can be used as is with in-use fuel injectors. However, it is preferable to destroy the soaps in the fuel lines just before it enters the injectors. To do this, one can inject a degelling agent selected from the group consisting of methyl amine, ethyl amine, n-propyl amine, iso-propyl amine, the primary butyl amines and the primary pentyl amines into the fuel line. Any of these amines will destroy the aluminum soaps allowing the fuel to pass into and through the injectors as though it had never had a demisting agent added. The amines should be added to a fuel line at a rate which provides from about 0.001 to 0.005 gram of amine for every gram of fuel passing the point of injection. It is preferable, although not necessary, to inject the amine into the fuel line at a point just prior to where the fuel leaves the line and enters the engine injector. Copending U.S. patent application Ser. No. 475,688 filed June 3, 1974 describes a method for degelling fuel prior to injecting it into a jet engine.

What is claimed is:

1. A composition of matter consisting of a mixture of a jet fuel and an aluminum di-acid soap of a saturated carboxylic acid having from 8 to 20 carbon atoms, the amount of said soap being limited to 0.1 to 1 percent of the total weight of the composition in order to leave the viscosity of the mixture low enough to permit the use of the mixture as a propellant of a jet aircraft of the type wherein the propellant travels to an aircraft engine from a fuel tank through a fuel line.

* * * * *